United States Patent [19]

Mason

[11] 3,966,212

[45] June 29, 1976

[54] SIMULATED GOLF GREEN

[76] Inventor: Richard Mason, 637-39 E. Olney Road, Norfolk, Va. 23510

[22] Filed: Nov. 14, 1975

[21] Appl. No.: 632,070

[52] U.S. Cl. ..... 273/181 A; 273/178 B; 273/181 J; 273/185 R; 273/102.1 C; 272/8 R

[51] Int. Cl.[2] ..... A63B 69/36

[58] Field of Search ..... 273/176, 181, 182, 177, 273/178, 179, 183, 184, 185, 102 B, 102.1 G, 102.1 C, 102 R, 105 A; 272/8 R, 15, 16

[56] References Cited

UNITED STATES PATENTS

| | | | |
|---|---|---|---|
| 3,072,410 | 1/1963 | Simjian | 273/185 A |
| 3,413,005 | 11/1968 | Stearns | 273/181 A X |
| 3,558,140 | 1/1971 | Romeo | 273/181 A |
| 3,599,977 | 8/1971 | Glass et al. | 273/102 R |
| 3,814,439 | 1/1973 | Simon | 273/181 R |
| 3,889,957 | 6/1975 | Klabacka | 273/185 R |

*Primary Examiner*—George J. Marlo
*Attorney, Agent, or Firm*—Armstrong, Nikaido & Wegner

[57] ABSTRACT

A simulated golf green is provided which comprises a base including a base plate, a plurality of dividers mounted on the base plate which define a plurality of areas on the base plate, a plurality of holes through the base plate, one hole being located in each of the areas, and a plurality of channels mounted below the base plate each of the channels being positioned below one of the holes. A plurality of surface plates are positioned over the base, the surface plates forming a substantially contiguous cover thereover which has the appearance pf a golf green. A plurality of supports are mounted on the base plate, each support supporting one of the surface plates such that the surface plates can tilt with respect to the support at 360° around the axis of the supports. Thus when a golf ball strikes a surface plate, it will tilt toward the side on which it was struck and the golf ball will fall off the surface plate onto one of the areas on the base plate and then through the hole in the base plate which is in the area. When the ball falls through the hole it falls into one of the channels positioned beneath the base plate. A detector is provided for detecting the presence of the golf ball in the channel.

5 Claims, 6 Drawing Figures

SIMULATED GOLF GREEN

BACKGROUND OF THE INVENTION

The present invention is directed to a simulated golf green and more particularly to a golf green which has a plurality of surface plates having the appearance of a golf green positioned over a base plate, each surface plate being supported by a coiled spring so that the surface plate can tip in any radial direction with respect to the axis of the spring.

DESCRIPTION OF THE PRIOR ART

Prior art simulated golf games are generally of two types. In the first type, a golf ball is hit against a vertical board having a plurality of plates which rotate about horizontal supports so that when the ball hits a plate, it rotates the plate about the support. The golf ball then passes through the area previously occupied by the plate and activates some type of detector to provide an indication of the particular plate which has been rotated by the ball. In this type of prior art device, each plate has a separate detector to provide an indication that it has been struck and rotated by the ball. The disadvantage of this type of device is that it requires a detector for each of the plates. Also, the board itself does not simulate an actual fairway or golf green.

A second type of prior art simulated golf green, comprises a horizontally positioned green which is divided into a plurality of areas, each area being given a particular weight depending upon its proximity to the hole which corresponds to the hole on a regular golf green. However, this type of prior art device does not include a plurality of surface plates which are positioned contiguous to each other in order to provide an overall appearance of an actual golf green.

SUMMARY OF THE INVENTION

It is the primary object of this invention to provide a simulated golf green which resembles in appearance an actual golf green.

It is another object of the present invention to provide a simulated golf green which resembles an actual golf green but which may vary in size depending upon the particular purpose. In particular, the size can range from a very small size compatible with a pinball machine arrangement to that of a very large size which is comparable to that of an actual green and which may be used with actual golf balls hit from a substantial distance from the simulated green.

It is still another object of the present invention to provide a simulated golf green which has a plurality of contiguous surface plates positioned over a base, the surface plates being tiltable at 360° around an axis of its support member.

It is still another object of the present invention to provide a base positioned beneath the plurality of plates, the base comprising a base plate which is divided into a plurality of areas, each area being given a particular weighted score depending upon its proximity to the golf hole in the green.

It is still a further object of the present invention to provide a simulated golf green in which each area of the base has a hole therein and a channel positioned beneath the hole such that a ball landing in a particular area will pass through the hole and into the channel.

It is still a further object of the present invention to provide a detector in each channel for detecting the presence of a golf ball in the channel and to provide an indication thereof.

It is still a further object of the present invention to provide an indicator which produces an indication on activation by the detector, the indication being indicative of the area of the base plate to which the detector corresponds.

The present invention provides a simulated golf green which includes a base comprising a base plate and a plurality of dividers mounted on the base plate, the plurality of dividers defining a plurality of areas on the base plates. A plurality of holes pass through the base plate, one of the holes being located in each of the areas. A plurality of channels are mounted on the base plate, each of the channels being positioned below one of the holes. A plurality of surface plates are positioned over the base, the surface plates forming a substantially contiguous cover thereover. The surface plates have the appearance of a golf green. This can be accomplished, for example, by covering the surface plates with a material resembling grass such as Astro-Turf or by painting the surface plates with green paint. A plurality of supports are mounted on the base plate, each support supporting one of the surface plates such that the surface plates can tilt at 360° around the axis of the support. In this arrangement when a golf ball strikes one of the surface plates, it tilts the surface plate and falls into one of the areas on the base plate. The ball then passes through the hole which corresponds to the area and then into the channel which is located below that hole. A detector is provided for detecting the presence of the golf ball in the channel. The supports for the surface plates comprise a coiled spring which can tilt along any of the radii extending from its axis and thus can tilt 360° about its axis. The divider which divides the base plate into the plurality of areas comprises wall members which are mounted on the base plate and are perpendicular thereto.

DETAILED DESCRIPTION OF THE DRAWINGS

DETAILED DESCRIPTION OF THE PREFERRED EMBODIMENT

Figure 1:
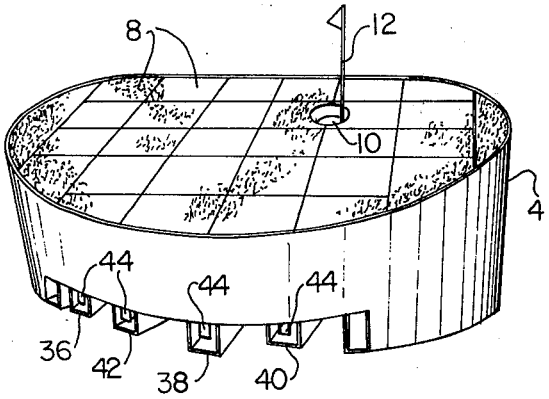
FIG. 1 is a perspective view of the simulated golf green of the present invention.
Figure 2:
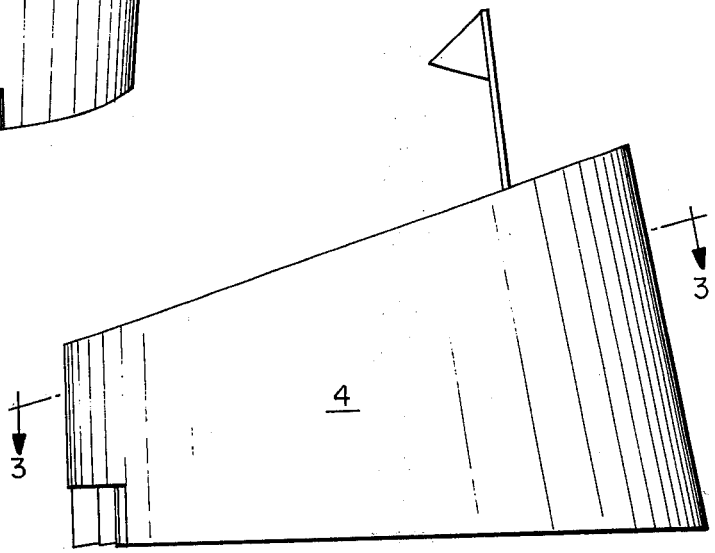
FIG. 2 is a side view of the simulated golf green of the present invention.
Figure 3:
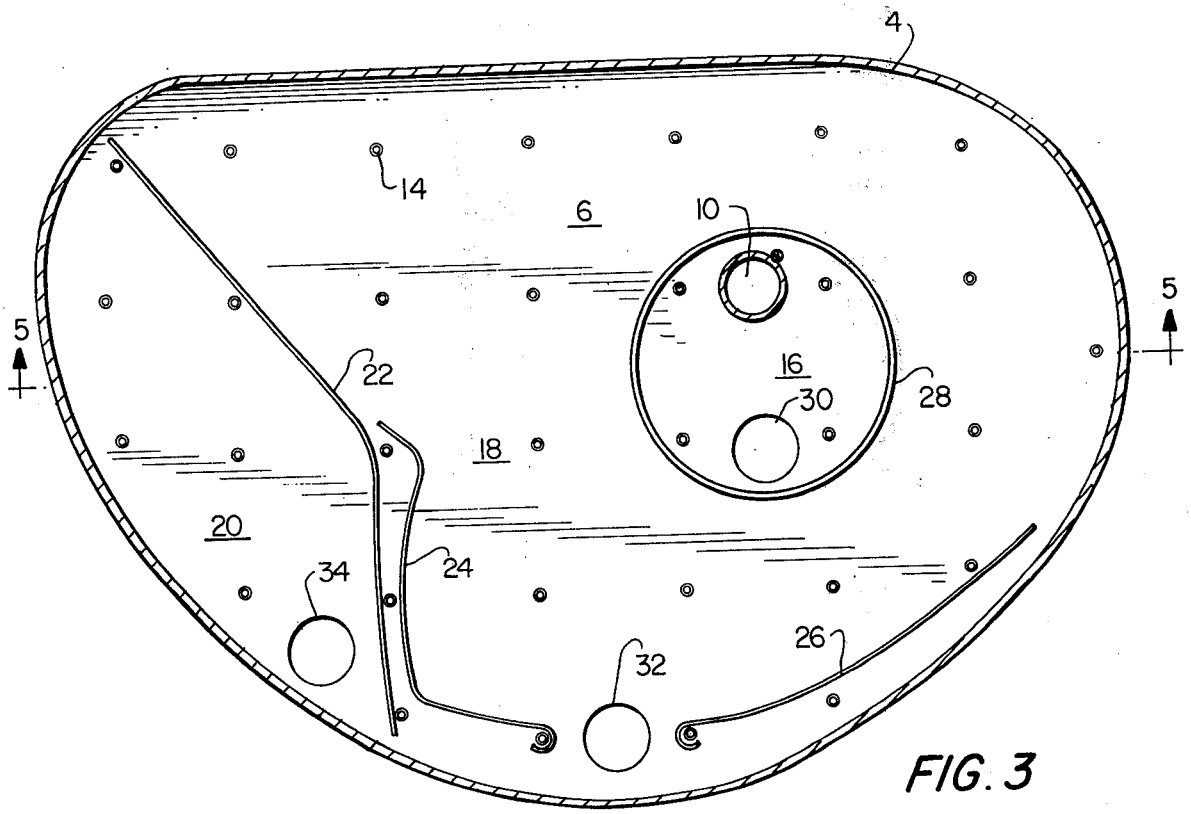
FIG. 3 is a section through line 3—3 of FIG. 2.
Figure 4:
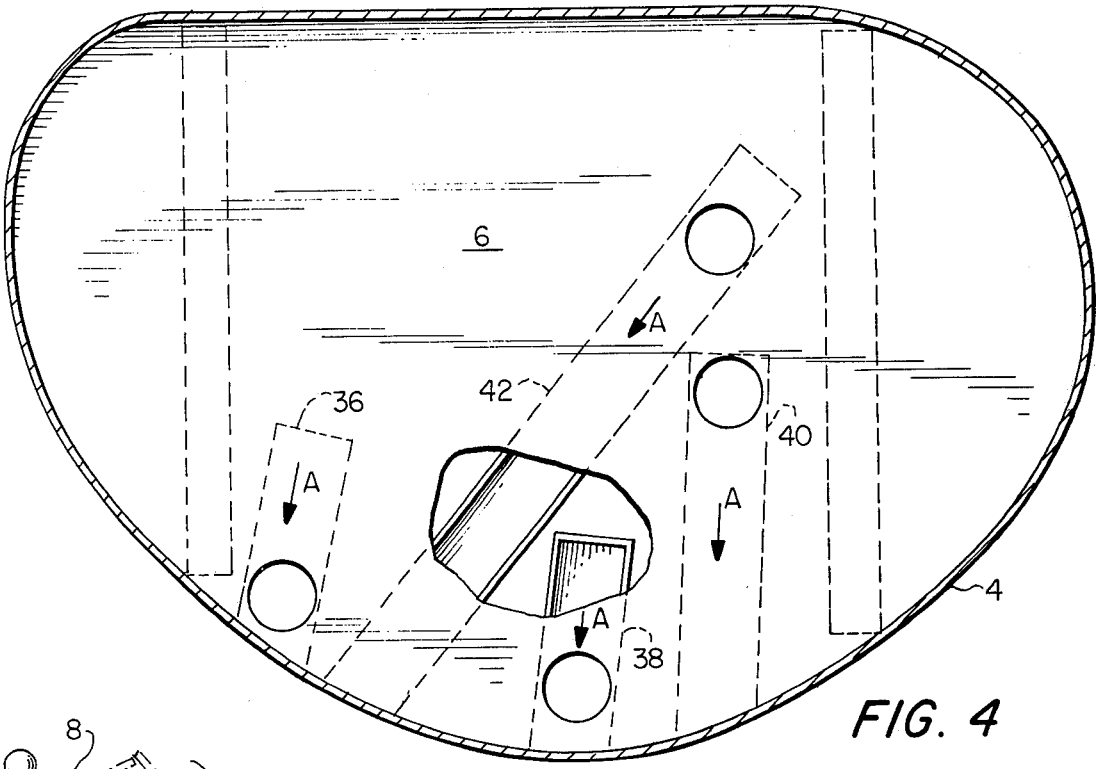
FIG. 4 is a partially cut-away top view of the present invention.

Referring to the drawings, a base 2 has side walls 4 and a base plate 6. The base plate 6 is covered by a plurality of contiguous surface plates 8 which may be painted or covered with some type of material so that it gives the appearance of a golf green. A hole 10 having a flag 12 extending therefrom corresponds to the hole on the golf green. It is this hole to which the person using the simulated golf green directs his golf shot.

Figure 6:
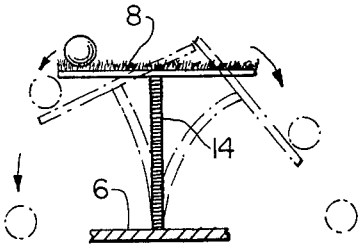
FIG. 6 illustrates the plate and support means of the present invention.
Figure 5:
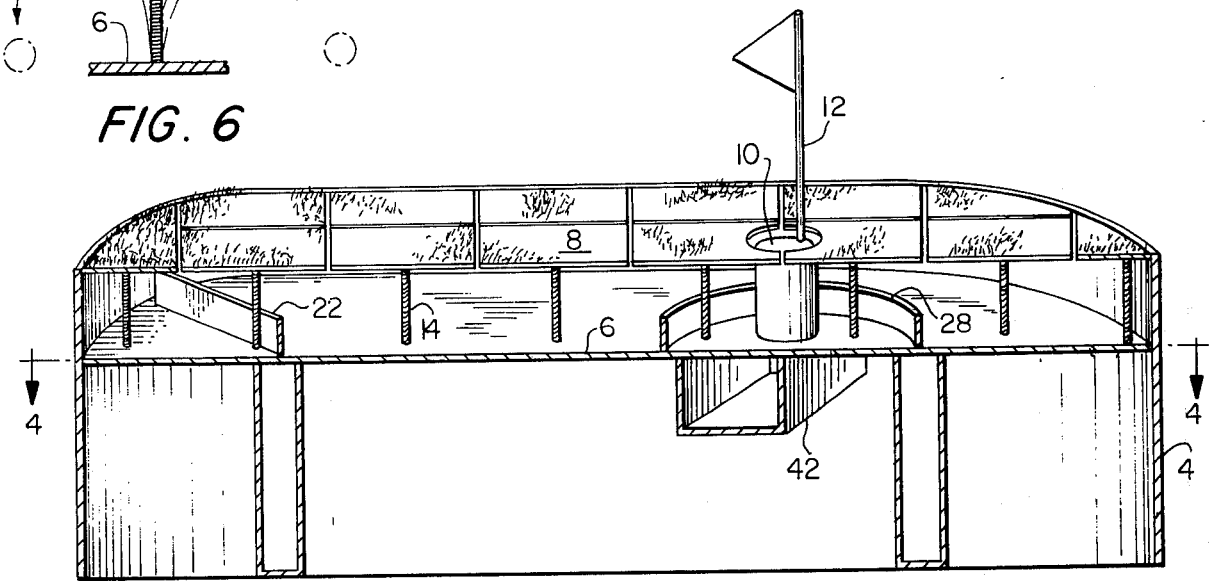
FIG. 5 is a section through line 5—5 of FIG. 3.

The surface plates 8 are spaced from the base plate 6 and are supported by coil springs 14 which are mounted on the base plate. Referring to FIG. 6, it can be seen that when a ball strikes the surface plate 8, it will cause the spring 14 to bend in a direction along a radius extending from the axis of the spring when it is in an upright position toward the position where the ball strikes the surface plate 8. The bending of the spring under the weight of the ball will cause surface plate 8 to tilt until the ball falls therefrom onto the base plate 6. The base plate 6 is divided into a plurality of areas 16, 18 and 20 by the dividers 22, 24, 26, and 28. For the purposes of score keeping, each of the areas can be given a particular value depending upon its proximity to the hole 10. For example, a ball landing in hole 10 would count as one stroke or a hole-in-one, a ball landing in area 16 would count as two strokes, a ball landing in area 18 would correspond to three strokes or a ball landing in area 20 would correspond to four strokes. Each of the areas 16, 18 and 20 have a hole 30, 32 and 34, respectively, located therein. When a ball falls from a surface plate 8, as illustrated in FIG. 6, it will land in one of the areas on the base plate 6 and due to the inclination of the base plate 6, will roll toward and eventually fall through one of the holes 30, 32 or 34. The channels 36, 38, 40 and 42 are positioned beneath the holes 34, 32, 30 and 10, respectively, such that when a ball falls through one of the holes, it enters the channel and rolls in the direction of arrow A. When the ball reaches the end of the channel, which it has entered, it contacts one of the switches 44 in that channel. The switch is connected into a circuit (not shown) to provide an indication of the channel in which the ball was located. This is indicative of the area of the base plate on which the ball has landed and thus the operation of the switch 44 will produce an indication such as the number of strokes which corresponds to the area and thus produces a score which represents the player's skill in trying to hit a ball into the hole 10.

Because of the fact that the surface plates 8 can be tilted at 360° around the axis of the spring, the location of the wall members 22, 24, 26 and 28 is not critical. In the situation where a surface plate 8 is positioned directly above one of the wall members, the ball will fall to one side or the other of the wall member depending on the point at which it hits the surface plate 8. Thus, it is not necessary to provide precise alignment of the wall members and the plates and thus manufacturing is greatly facilitated.

The size of the simulated green will depend upon the type of game into which it is incorporated. For example, the simulated green can be made small enough to be part of a pinball machine or a children's game where the ball can be a marble. Naturally, the spring 14 is selected so that the surface plate 8 will be tipped by the particular type of ball which is used. In another embodiment, the simulated green can be made several feet in diameter so that it can be used with an indoor golf game in which a player could use a regular golf club and golf ball and chip the ball onto the green from a distance of 10 to 50 feet, for example. In still another embodiment, the simulated green can be of a size corresponding to a regular golf green and used at a driving range, for example. The ball could be hit with a regular golf club at any distance from 10 feet to 100 yards, if desired. It is apparent from the disclosure that because of the fact that the surface of the green is made of a plurality of surface plates which can be of any size, that the invention has great versatility because it can be made any size to accommodate the particular needs of a user.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore to be embraced therein.

What is claimed is:

1. A simulated golf green comprising:

a. a base means comprising a base plate, a plurality of divider means mounted on said base plate, said divider means defining a plurality of areas on said base plate, a plurality of holes through said base plate, one of said holes being located in each of said areas, and a plurality of channel means mounted on said base plate, each of said channel means being positioned below one of said holes;

b. a plurality of surface plates positioned over said base means, said surface plates forming a substantially contiguous cover thereover;

c. a plurality of support means mounted on said base plate, each support means supporting one of said surface plates such that said surface plates can tilt with respect to said support means at 360° around the axis of said support means, wherein when a golf ball strikes one of said surface plates it tilts said surface plate falling therefrom into one of said areas of said base plate and then through the hole in said base plate located in said area into one of said channel means; and d. detector means for detecting the presence of the golf ball in said channel.

2. The simulated golf green of claim 1, wherein each of said support means comprise a coiled spring.

3. The simulated golf green of claim 1, wherein said detector means is an electrical switch.

4. The simulated golf green of claim 1, wherein said divider means comprise wall members mounted on said base plate and perpendicular thereto.

5. The simulated golf green of claim 1, wherein said surface plate means have the appearance of a golf green.

* * * * *